US006852461B2

(12) United States Patent
Sato et al.

(10) Patent No.: US 6,852,461 B2
(45) Date of Patent: Feb. 8, 2005

(54) DEVELOPING AGENT

(75) Inventors: Shuitsu Sato, Tokyo (JP); Takashi Urabe, Shizuoka-ken (JP); Yasuhito Noda, Mishimi (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 35 days.

(21) Appl. No.: 10/230,136

(22) Filed: Aug. 29, 2002

(65) Prior Publication Data

US 2004/0043318 A1 Mar. 4, 2004

(51) Int. Cl.[7] ..... G03G 9/087
(52) U.S. Cl. ..... 430/109.4; 430/108.8; 430/111.4
(58) Field of Search ..... 430/109.4, 108.8, 430/111.4

(56) References Cited

U.S. PATENT DOCUMENTS 5,300,386 A * 4/1994 Kanbayashi et al. ..... 430/99
2001/0018157 A1 8/2001 Aoki et al.
2002/0042013 A1 * 4/2002 Aoki et al. ..... 430/111.4
2003/0180645 A1 * 9/2003 Tavernier et al. ..... 430/109.4

FOREIGN PATENT DOCUMENTS

| | | |
|---|---|---|
| JP | 8-106173 | 4/1996 |
| JP | 2001-194830 | 7/2001 |
| JP | 2001-222138 | 8/2001 |

OTHER PUBLICATIONS

U.S. patent application Ser. No. 10/293,323, Urabe et al., filed Nov. 14, 2002.

* cited by examiner

*Primary Examiner*—Mark A. Chapman
(74) *Attorney, Agent, or Firm*—Foley & Lardner LLP

(57) ABSTRACT

A binder resin includes a first polyester resin having a high softening point Sp1, a second polyester resin having a softening point Sp2 higher than the softening point Sp1, a first wax having a melting point Mp1 higher than the softening point Sp2, and a second wax having a melting point Mp2 lower than the softening point Sp2.

11 Claims, 1 Drawing Sheet

DEVELOPING AGENT

BACKGROUND OF THE INVENTION

The present invention relates to a developing agent used in an image forming apparatus such as an electrostatic copying machine, or a laser beam printer.

The heat roll fixing method is superior to other fixing methods in that an image can be fixed at a high speed, energy efficiency is high, and adverse effects on the environment by, for example, the evaporation of solvents can be suppressed.

On the other hand, it is pointed out as a defect inherent in the heat roll fixing method that so-called "low temperature offset" and "high temperature offset", i.e., the phenomenon that the toner image is brought into a direct contact with the fixing roll or the belt under a low temperature or a high temperature, tend to easily occur.

The low temperature offset is the phenomenon in which the toner image is not sufficiently melted under a low temperature and, thus, the toner is cracked when the toner image is brought into contact with the fixing roller. On the other hand, the high temperature offset is the phenomenon in which the molten state of the toner is rendered excessive under a high temperature, which causes the toner to adhere to, for example, the fixing roll.

It is desirable for the temperature at which the low temperature offset is generated to be low and for the temperature at which the high temperature offset is generated to be high. Along this line, various ideas have been proposed to date. It has been suggested that the molecular weight distribution of the binder resin should be broadened, and that a low molecular weight propylene series resin having a molecular weight falling within a prescribed range should be added to the binder resin, as a release agent. It has also been proposed that, in order to obtain a toner excellent in the low temperature fixing properties and in the resistance to offset, the toner should contain two kinds of wax components.

On the other hand, it is desirable in view of the energy saving to shorten the waiting time until the temperature of the fixing device is elevated to reach the temperature at which the fixing device is operated and to carry out the fixing operation at a lower temperature. As a method of lowering the fixing temperature, it is known to the art to use a toner containing, as a binder resin, both a crystalline polyester and a amorphous polyester resin, as disclosed in, for example, Jpn. Fat. KOKAI Publication No. 2001-222138.

However, the toners that have been proposed do not satisfy all the requirements and, thus, some problems remain unsolved. For example, some conventional toners, which are excellent in the resistance to the high temperature offset and in the developing performance, are insufficient in the low temperature fixing properties. Also, other conventional toners, which are excellent in the resistance to the low temperature offset and in the low temperature fixing properties, are somewhat unsatisfactory in the resistance to the blocking and in the developing properties. In short, the conventional toners do not simultaneously satisfy the resistance to the offset under low and high temperatures.

BRIEF SUMMARY OF THE INVENTION

An object of the present invention is to provide a developing agent excellent in low temperature fixing properties, resistance to low temperature offset, resistance to high temperature offset, smear resistance, and capable of exhibiting stable charging properties and image concentration over a long time regardless of environmental conditions.

According to the present invention, there is provided a developing agent containing toner particles, the toner particle containing a binder resin and a coloring agent, the binder resin containing a first polyester resin having a softening point Sp1, a second polyester resin having a softening point Sp2 higher than the softening point Sp1 and having crystalline characteristics, a first wax having a melting point Mp1 higher than the softening point Sp2, and a second wax having a melting point Mp2 lower than the softening point Sp2.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the present invention, and together with the general description given above and the detailed description of the preferred embodiments given below, serve to explain the principles of the present invention.

DETAILED DESCRIPTION OF THE INVENTION

The developing agent according to a first aspect of the present invention comprises a coloring agent and a binder resin. The binder resin contains a first polyester resin, a second polyester resin, and an optional component of a third polyester resin. These first, second and third polyester resins differ from each other in the softening point. The binder resin also contains a first wax and a second wax, differing from the first wax in the melting point.

The first polyester resin used in the present invention has a softening point Sp1, and the melt characteristics show the amorphous characteristics.

The second polyester resin used in the present invention has a softening point Sp2 higher than the softening point Sp1 and the melt characteristics show the crystalline characteristics.

The third polyester resin used in the present invention has a softening point Sp3 higher than the softening point Sp2 and the melt characteristics of the amorphous characteristics.

The first wax used in the present invention has a melting point Mp1 higher than the softening point Sp2.

Further, the second wax used in the present invention has a melting point Mp2 lower than the softening point Sp2.

The developing agent according to a second aspect of the present invention contains toner particles comprising a binder resin and a coloring agent, said binder resin containing the first polyester resin noted above, the second polyester resin noted above, and the third polyester resin noted above, at least one of said first to third polyester resins having a crystallizability.

In the developing agent according to the second aspect of the present invention, it is desirable for the content of the second polyester resin to be lower than the content of any of the first and third polyester resins.

Also, in the developing agent according to the second aspect of the present invention, it is desirable for the binder resin to further contain the first wax noted above and the second wax noted above.

The present invention also provides an image forming apparatus to which the developing agent referred to above can be applied satisfactorily, comprising:

an image carrier;

a developing device arranged to face said image carrier and housing the developing agent referred to above for forming a developing agent image by developing the electrostatic latent image formed on said image carrier in accordance with the image information;

a transfer device for transferring the developing agent image onto a recording material; and a fixing device for fixing the developing agent image transferred onto said recording material.

The difference between the crystalline characteristics and the amorphous characteristics will now be described with reference to the graph of FIG. 1.

Figure 1:
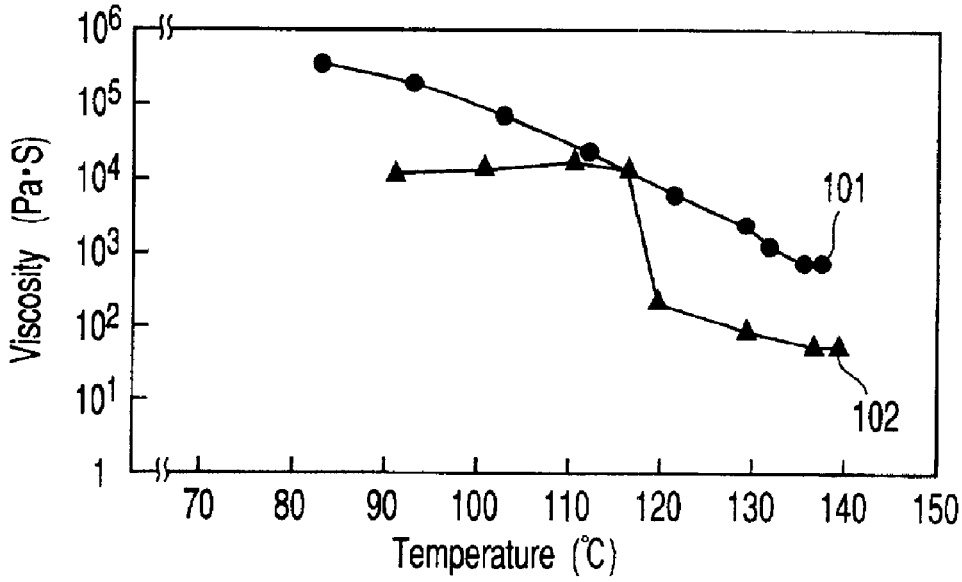
FIG. 1 is a graph showing the relationship between the melt viscosity of the polyester resin and the temperature of the polyester.

Specifically, FIG. 1 is a graph showing the relationship between the melt viscosity and the temperature in respect of a polyester resin having crystalline characteristics, and also having a softening point of 120° C., and another polyester resin having amorphous characteristics and a softening point of 105° C.

As shown in FIG. 1, the viscosity of the polyester resin having the amorphous characteristics, which is denoted by curve 101, is moderately decreased over a wide temperature range with increase in the temperature. On the other hand, the polyester resin having crystalline characteristics, which is denoted by curve 102, has a narrow temperature range within which the viscosity is sharply decreased with increase in the temperature.

The first wax used in the present invention has a melting point higher than the softening point Sp2 of the second polyester resin. Also, the second wax used in the present invention has a melting point lower than the softening point Sp2 of the second polyester resin.

According to the present invention, the binder resin of the developing agent contains the second polyester resin together with the first polyester resin. The second polyester resin, which is crystalline, has a narrow temperature range within which the viscosity is sharply decreased with increase in the temperature and also has a softening point somewhat higher than that of the first binder resin. As a result, the low temperature fixing properties of the developing agent are improved.

Also, according to the present invention, the binder resin of the developing agent contains a first wax having a melting point higher than the softening point of the second polyester resin. As a result, the first wax and the first polyester resin collectively produce a synergetic effect so as to further improve the high temperature offset.

In addition, according to the present invention, the binder resin of the developing agent contains a second wax having a melting point lower than the softening point of the second polyester resin. As a result, the second wax and the second polyester resin collectively produce a synergetic effect so as to improve not only the low temperature fixing properties but also the low temperature offset properties of the developing agent.

Note that, if a third polyester resin having amorphous characteristics and a high softening point is added to the binder resin of the developing agent, the generation of the high temperature offset is suppressed, and the storage capability of the developing agent is improved.

Further, in the case of using the third polyester resin having a high softening point, the third polyester and the first wax collectively produce a synergetic effect so as to further improve the high temperature offset properties.

As described above, the developing agent of the present invention contains a binder resin containing the first polyester resin having the amorphous characteristics and a low softening point, the second polyester resin having the crystalline characteristics and a somewhat high softening point, first and second waxes having melting points higher than and lower than the softening point of the second polyester resin, respectively, and, preferably, the third polyester resin having a high softening temperature. The particular construction of the binder resin permits sufficiently suppressing the high temperature offset and the low temperature offset of the developing agent and also permits further improving the low temperature fixing properties of the developing agent.

A desired value of the softening point can be set in accordance with the fixing temperature. In general, the fixing temperature of the developing agent falls within a range of between 140° C. and 210° C. The softening point Sp1 in this case should fall desirably within a range of between 80° C. and 120° C. Also, the softening point Sp2 in this case should fall desirably within a range of between 100° C. and 140° C. Further, the softening point Sp3 in this case should fall desirably within a range of between 130° C. and 170° C.

Note that it is possible for the difference between the glass transition point Tg1 and the softening point Sp1 of the first polyester resin having the amorphous characteristics to be a relatively large value falling within a range of between 30° C. and 50° C. Also, it is possible for the difference between the glass transition point Tg3 and the softening point Sp3 of the third polyester resin having the amorphous characteristics to be a relatively large value falling within a range of between 80° C. and 100° C. However, it is possible for the difference between the glass transition point Tg2 and the softening point Sp2 of the second polyester resin, which has the crystalline characteristics, to be a relative small value falling within a range of between 0.1° C. and 10° C. Also, it is possible for the glass transition point Tg2 to be higher or lower than the softening point Sp2.

The melting point Mp1 of the first wax is higher than the softening point Sp2 of the second polyester resin by, preferably at least 10° C., and more preferably by 10° C. to 40° C. Also, the melting point Mp2 of the second wax is higher than the softening point Sp2 of the second polyester resin by, preferably at least 10° C., and more preferably by 10° C. to 50° C.

It is desirable for the second polyester resin to be contained in the binder resin in an amount larger than that of the first polyester resin, and for the first polyester resin to be contained in the binder resin in an amount larger than that of the third polyester resin. The mixing ratio of the second, first and third polyester resins should desirably fall within a range of 35 to 75: 2 to 25: 0 to 55, more desirably should fall within a range of 40 to 70: 5 to 20: 0 to 50. Where the mixing ratio falls within the range of 35 to 75: 2 to 25: 0 to 55, the developing agent is rendered excellent in the low temperature fixing properties and tends to be rendered excellent in any of the resistance to low temperature offset and the resistance to smear. However, if the mixing ratio of the first, second and third polyester resins fails to fall within the range noted above, the developing agent tends to be rendered poor in at least one of low temperature fixing properties, the resistance to low temperature offset, the resistance to high temperature offset and the resistance to smear.

The softening point used in the present specification is determined by using a CFT-500 (trade name of an overhead flow tester, manufactured by Shimazu Seisakusho K.K.). To be more specific, 1 $cm^3$ of a sample is allowed to melt flow through a nozzle having a length of 1 mm and provided with a fine hole having a diameter of 1 mm under a load of 20 $kg/cm^2$ and a temperature elevation rate of 6° C./min. The temperature at the point corresponding to ½ of the height between the flow starting point and the flow finishing point is used as the softening point in the present specification.

Also, the glass transition point used in the present specification denotes the value measured by the method specified in ASTM D3418-82.

In the ASTM method referred to above, the intersection between the inclination of the heat absorption peak measured by using the DSC method and the base line is determined as the glass transition point. To be more specific, a sample is heated to 180° C. with alumina used as a reference, maintained at 180° C. for 10 minutes and, then, cooled to room temperature at a cooling rate of 10° C./min by using, for example, DSC-200 (trade name of a differential scanning calorimeter manufactured by Seiko Denshi Kogyo K. K). Then, the sample is measured at a temperature elevation rate of 10° C./min, followed by finding the intersection between an extension of the base line not higher than 50° C. and a tangential line denoting the maximum inclination between the rising point of the heat absorption peak and the peak point of the heat absorption so as to determine the glass transition point.

The first polyester resin used in the present invention can be obtained by using a known polyhydric alcohol component, and a monomer containing a polyhydric carboxylic acid component such as a carboxylic acid, a carboxylic acid anhydride, and a carboxylic acid ester. The acid component contained in the first polyester resin includes, for example, a dicarboxylic acid such as phthalic acid, isophthalic acid, terephthalic acid, fumaric acid or maleic acid; succinic acid substituted by an alkyl group having 1 to 20 carbon atoms or an alkenyl group having 2 to 20 carbon atoms such as dodecenyl succinic acid and octyl succinic acid; trimellitic acid, pyromellitic acid and acid anhydrides and alkyl esters thereof. It is desirable for the first polyester resin to contain at least one of these acid components.

The alcohol component of the first polyester resin includes, for example, an aliphatic polyol such as ethylene glycol, propylene glycol, 1,4-butane diol, 1,3-butane diol, 1,5-pentane diol, 1,6-hexane diol, neopentyl glycol, glycerin, trimethylol ethane, trimethylol propane or pentaerythritol; an alicyclic polyol such as 1,4-dicyclohexane diol, or 1,4-cyclohexane dimethanol; ethylene oxide or propylene oxide adduct of such as bisphenol A.

It is desirable for the first polyester resin to have a softening point of 80 to 120° C., a glass transition point of at least 40° C., a difference between the softening point and the glass transition point of 30 to 50° C., and an acid value (KOH/g) of at least 5, and to contain at least 70 mol % of an aromatic polycarboxylic acid component. It is possible to use a single kind of the first polyester resin or a mixture of at least two kinds of the first polyester resins.

The second polyester resin used in the present invention can be obtained by using, for example, a monomer containing a carboxylic acid component consisting of a polyhydric carboxylic acid compound having a valency of at least two and an alcohol component consisting of a polyhydric alcohol having a valency of at least two. The acid component of the second polyester resin includes, for example, fumaric acid, maleic acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or succinic acid substituted by an alkyl group having 1 to 20 carbon atoms or an alkenyl group having 2 to 20 carbon atoms such as dodecenyl succinic acid or octyl succinic acid, an anhydride of the acids and a derivative such as an alkyl ester of the acids. On the other hand, the alcohol component of the second polyester resin includes, for example, an aliphatic polyol such as ethylene glycol, propylene glycol, 1,4-butane diol, 1,3-butane diol, 1,5-pentane diol, 1,6-hexane diol, neopentyl glycol, glycerin, trimethylol ethane, trimethylol propane or pentaerythritol; an alicyclic polyol such as 1,4-cyclohexane diol or 1,4-cyclohexane dimethanol; and ethylene oxide or propylene oxide adduct of such as bisphenol A.

Particularly, it is desirable for the second polyester resin used in the present invention to be a usually wax-like crystalline compound obtained by the condensation polymerization between a carboxylic component containing at least 80 mol % of fumaric acid and an alcohol component containing an alkyl or alkenyl group having 1 to 6 carbon atoms or a diol having 2 to 6 carbon atoms and at least 80 mol % of a diol having 2 to 6 carbon atoms. It is also desirable for the second polyester resin used in the present invention to have a softening point of 100 to 140° C., a glass transition point of 100 to 140° C., and a difference between the melting point and the glass transition point of 0.1 to 10° C. It is possible to use a single kind of the second polyester resin or a mixture of at least two kinds of the second polyester resins.

The third polyester resin used in the present invention can be obtained by using a monomer containing a carboxylic acid component consisting of a polyhydric carboxylic acid compound having a valency of at least two and an alcohol component consisting of a polyhydric alcohol having a valency of at least two.

The acid component of the third polyester resin includes, for example, fumaric acid, maleic acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or succinic acid substituted by an alkyl group having 1 to 20 carbon atoms or an alkenyl group having 2 to 20 carbon atoms such as dodecenyl succinic acid or octyl succinic acid, an anhydride of the acids and a derivative such as an alkyl ester of the acids. On the other hand, the alcohol component of the third polyester resin includes, for example, an aliphatic polyol such as ethylene glycol, propylene glycol, 1,4-butane diol, 1,3-butane diol, 1,5-pentane diol, 1,6-hexane diol, neopentyl glycol, glycerin, trimethylol ethane, trimethylol propane or pentaerythritol; an alicyclic polyol such as 1,4-cyclohexane diol or 1,4-cyclohexane dimethanol; and ethylene oxide or propylene oxide adduct of such as bisphenol A.

Particularly, it is desirable for the third polyester resin used in the present invention to be a compound obtained by the condensation polymerization between a carboxylic component containing an alkyl group or an alkenyl group having at least 16 carbon atoms and at least 80 mol % of fumaric acid and an alcohol component and at least 80 mol % of a diol having 2 to 6 carbon atoms. It is also desirable for the third polyester resin used in the present invention to have a softening point of 130 to 170° C., a glass transition point of at least 40° C., a difference between the softening point and the glass transition point of 80 to 100° C. and an acid value of at least 20 (KOH/g) and to contain at least 80 mol % of an aromatic carboxylic acid component. It is possible to use a single kind of the third polyester resin or a mixture of at least two kinds of the third polyester resins.

Preferably used in the present invention are at least two kinds of waxes including a first wax having a melting point higher by at least 10° C. than the softening point Sp2 of the second polyester resin, and a second wax having a melting point lower by at least 10° C. than the softening point Sp2 of the second polyester resin.

The waxes that satisfy the requirements described above and, thus, can be used in the present invention include, for example, an aliphatic hydrocarbon series wax such as a low molecular weight polyethylene, a low molecular weight polypropylene, a polyolefin copolymer, a polyolefin wax, a microcrystalline wax, a paraffin wax, or Fischer-Tropsch wax; an oxide of an aliphatic hydrocarbon series wax such as an oxidized polyethylene wax or a block copolymer thereof; a plant wax such as candelilla wax, carnauba wax, Japan wax, jojoba wax, or rice wax; an animal wax such as beeswax, lanolin, or whale wax; a mineral wax such as ozokerite, ceresin, or petrolactum; waxes containing a fatty acid ester as a main component such as a montanic acid ester wax and a castor wax; and waxes prepared by deoxidizing partially or entirely a fatty acid ester such as a deoxidized carnauba wax.

Further, the waxes used in the present invention further include, for example, a saturated linear fatty acid such as palmitic acid, stearic acid, montanic acid or a long chain alkyl carboxylic acid having a long chain alkyl group; an unsaturated fatty acid such as brasidinic acid, eleostearic acid, or varinaric acid; a saturated alcohol such as stearyl alcohol, eicosyl alcohol, behenyl alcohol, carnaubyl alcohol, ceryl alcohol, melissyl alcohol or a long alkyl chain alcohol having a long chain alkyl group; a polyhydric alcohol such as sorbitol; a fatty acid amide such as linoleic acid amide, oleic acid amide, or lauric acid amide; a saturated fatty acid bis-amide such as methylene bis-stearic acid amide, ethylene bis-capric acid amide, ethylene bis-lauric acid amide, or hexamethylene bis-stearic acid amide; an unsaturated fatty acid amide such as ethylene bis-oleic acid amide, hexamethylene bis-oleic acid amide, N,N'-dioleyl adipic acid amide, or N,N'-dioleyl sebacic acid amide; an aromatic bis-amide such as m-xylene bis-stearic acid amide or N,N'-distearyl isophthalic acid amide; a fatty acid metal salt (or a so-called "metallic soap") such as calcium stearate, calcium laurate, zinc stearate, or magnesium stearate; a wax prepared by grafting a vinyl series monomer such as styrene or acrylic acid to an aliphatic hydrocarbon series wax; a partial ester compound between a fatty acid such as behenic acid monoglyceride and a polyhydric alcohol; and a methyl ester compound having a hydroxyl group, which is obtained by hydrogenation of a plant fat or a plant oil.

The waxes having a melting point lower by at least 10° C. than 140° C., i.e., having a melting point not higher than 130° C., which are used in the present invention, include, for example, a plant wax and an animal wax such as candelilla wax having a melting point of 71° C., carnauba wax having a melting point of 83° C., rice wax having a melting point of 79° C., jojoba oil having a melting point of 95° C., white wax having a melting point of 53° C., beeswax having a melting point of 64° C.; an aliphatic hydrocarbon series wax such as paraffin wax having a melting point of 80 to 107° C.; a long chain ester wax having a melting point of 90 to 95° C.; a fatty acid ester wax having a melting point of 60 to 82° C.; a wax having an acidic group having a melting point of 73° C.; a fatty acid metal salt such as zinc stearate having a melting point of 123° C.; and montan wax having a melting point of 79 to 89° C., montanic acid ester wax having a melting point of 56 to 92° C., a maleic acid denatured wax having a melting point of 77 to 121° C., a microcrystalline wax having a melting point of 85 to 97° C. and its oxide, and a low density low molecular weight polyethylene having a melting point of 103 to 124° C. Also, the waxes having a melting point higher by at least 10° C. than 100° C., i.e., having a melting point not lower than 110° C., which are used in the present invention, include, for example, a high density low molecular weight polyethylene having a melting point of 124 to 133° C. and a low molecular weight polypropylene having a melting point of 145 to 164° C.

The first wax having a high melting point exhibits an effect in respect of the releasing function, and the second wax having a low melting point produces a plasticizing function. Also, the first wax having a high melting point contributes to the improvement in the resistance to the high temperature offset, and the second wax having a low melting point contributes to the improvement in the low temperature fixing properties.

Carbon black and an organic or inorganic pigment or dye can be used as the coloring agent in the present invention. The carbon black that can be used in the present invention includes, for example, acetylene black, furnace black, thermal black, channel black and Ketchen black. On the other hand, the pigment or dye that can be used in the present invention includes, for example, fast yellow G, benzidine yellow, indofast orange, irgasine red, carmin FB, permanent bordeaux FRR, pigment orange R, lithol red 2G, lake red C, rhodamine FB, rhodamin B lake, phthalocyanine blue, pigment blue, brilliant green B, phthalocyanine green and quinacridone. These pigments and/or dyes can be used singly or in the form of a mixture of at least two of these pigments and/or dyes.

In order to control the amount of charge caused by triboelectrification, it is possible to add, for example, a charge control agent to the developing agent of the present invention. Where, for example, carbon black or an achromatic color pigment or dye is used as the coloring agent, it is possible to use as the charge control agent a metal-containing azo compound containing at least one substance selected from the group consisting of a complex and a complex salt of, preferably, iron cobalt and chromium. Also, where a colored pigment or dye is used as the coloring agent, it is possible to use as the charge control agent a metal-containing salicylic acid derivative compound containing at least one substance selected from the group consisting of a complex and a complex salt of zirconium, zinc, chromium and boron.

In the case of using the developing agent of the present invention as a developing agent of a two-component system, it is possible to mix carrier particles with the toner particles. The carrier particle has a particle diameter of about 80 to 40 $\mu$m and comprises a core particle represented by (MO)X $(Fe_2O_3)$Y, X/Y<1.0, where M is one or a plurality of metals selected from the group consisting of Li, Mg, Mn, Fe(II), Co, Ni, Cu, Zn, Cd, Sr and Ba, and a silicone resin layer covering the surface of the core particle. Also, the carrier particle has a resistance value of $1\times10^{+10}$ to $3\times10^{+10}$ Ω under a gap of 250V/6.5 mm.

It is possible to add various additives to the developing agent of the present invention.

For example, it is possible to add 0.2 to 3% by weight of inorganic fine particles to the toner particles in order to control the fluidity and the charging properties of the developing agent. The inorganic fine particles used in the present invention include, for example, fine particles of silica, titania, alumina, strontium titanate and tin oxide. These inorganic fine particles can be used singly or in the form of a mixture of at least two of these inorganic fine particles.

For improving the environmental stability, it is desirable to use the inorganic fine particles subjected to a surface treatment with a hydrophobic agent. It is also possible to add resin fine particles having a particle diameter not larger than 1 $\mu$m to the toner particles in addition to the inorganic oxides for improving the cleaning function of the developing agent.

The present invention will now be described more in detail with reference to Examples of the present invention. In the following Examples, the expression "parts" represents "parts by weight".

EXAMPLES

Examples 1 to 13

Procedure of Polyester Rasins

Manufacture of First Polyester Resins A1, A2, A3

Mixed were 75 parts of BPA-PO(propylene oxide adduct of bisphenol A), 10 parts of terephthalic acid, 20 parts of fumaric acid, and 5 parts of dibutyl tin oxide. The mixture thus prepared was subjected to a reaction for 8 hours at 210 to 230° C. Then, the pressure in the reaction system was gradually lowered to reach a vacuum of 8 kPa, followed by further carrying out the reaction until a prescribed softening point was obtained so as to obtain the first polyester resin A1 having a softening point of 101° C., a glass transition point of 62° C., a difference between the softening point and the glass transition point of 39° C., and an acid value of 12 (KOH/g), and containing 95% of aromatic carboxylic acid component, the first polyester resin A2 having a softening point of 90° C., a glass transition point of 62° C., a difference between the softening point and the glass transition point of 30° C., and an acid value of 20 (KOH/g), and containing 95% of aromatic carboxylic acid component, and the first polyester resin A3 having a softening point of 115° C., a glass transition point of 68° C., a difference between the softening point and the glass transition point of 47° C., and an acid value of 5 (KOH/g), and containing 95% of aromatic carboxylic acid component.

Manufacture of Second Polyester Resins B1, B2

Mixed were 95 parts of 1,4-butane diol, 5 parts of glycerin, 100 parts of fumaric acid and 5 parts of hydroquinone, and the mixture thus prepared was subjected to a reaction for 5 hours under temperatures of 150 to 170° C. Then, the pressure in the reaction system was gradually lowered to reach a vacuum of 8 kPa, followed by further carrying out the reaction until a prescribed softening point was obtained so as to obtain the second polyester resin B1 having a softening point of 120° C., a glass transition point of 123° C., a difference between the softening point and the glass transition point of 3° C., and the second polyester resin B2 having a softening point of 110° C., a glass transition point of 120° C., a difference between the softening point and the glass transition point of 10° C.

The polyester resins A1 and A2 thus obtained were found to have the amorphous characteristics as denoted by the curve 101 shown in the graph of FIG. 1, and the polyester resins B1 and B2 were found to have the crystalline characteristics as denoted by the curve 102 shown in the graph of FIG. 1.

Manufacture of Third Polyester Resins C1, C2, C3

Mixed were 50 parts of BPA-PO (propylene oxide adduct of bisphenol A), 20 parts of BPA-BO (ethylene oxide adduct of bisphenol A), 14 parts of terephthalic acid, 12 parts of dodecenyl succinic acid anhydride, 8 parts of trimellitic acid anhydride, and 5 parts of dibutyl tin oxide, and the mixture thus obtained was subjected to a reaction for 8 hours under the temperatures of 210 to 230° C. Then, the pressure in the reaction system was gradually lowered to reach a vacuum of 8 kPa, followed by further carrying out the reaction until a prescribed softening point was obtained so as to obtain the third polyester resin C1 having a softening point of 148° C., a glass transition point of 59° C., a difference between the softening point and the glass transition point of 90° C., and an acid value of 30 (KOH/g), and containing 95% of aromatic carboxylic acid component, the third polyester resin C2 having a softening point of 135° C., a glass transit on point of 60° C., a difference between the softening point and the glass transition point of 75° C., and an acid value of 5 (KOH/g), and containing 95% of aromatic carboxylic acid component, and the third polyester resin C3 having a softening point of 160° C., a glass transition point of 70° C., a difference between the softening point and the glass transition point of 90° C., and an acid value of 25 (KOH/g), and containing 95% of aromatic carboxylic acid component. Table 1 shows the temperature characteristics of the first polyester resins A1 to A3, the second polyester resins B1, B2, and the third polyester resins C1 to C3.

Example of Carrier Manufacture

Manufacture of Ferrite Core

Roughly pulverized and mixed for 10 hours in a wet ball mill were 14 mol % of MnO, 16 mol % of MgO and 70 mol % of $Fe_2O_3$, followed by drying the pulverized material and maintaining the pulverized material at 950° C. for 4 hours. The roughly pulverized mixture was further pulverized finely in a wet ball mill so as to decrease the particle diameter of the finely pulverized material to 5 $\mu$m or less and, thus, to prepare a slurry. The slurry thus prepared was granulated and dried, and maintained at 1140° C. for 6 hours, followed by pulverizing the granulated material and classifying the pulverized material so as to obtain a ferrite core formed of the classified powdery material having an average particle diameter of 43 to 74 $\mu$m. The ferrite core thus obtained was found to consist of 14 mol % of MnO, 15 mol % of MgO and 71 mol % of $Fe_2O_3$. Also, the ratio X/Y was found to be 0.45.

Covering Layer of Ferrite Core

The obtained ferrite core was coated with 5 parts of an amino group-substituted silicone resin relative to 100 parts of the carrier by using a fluidized bed. The obtained coating film was baked at 190° C. for 3 hours so as to obtain a carrier coated with the resin. The resistance value of the carrier thus obtained was found to be $2\times10^{+11}$ Ω under a gap of 250V/6.5 mm.

Then, mixed by using a Henschel mixer were 100 parts of the binder resin, 6 parts of the coloring agent, 2 parts of the charge control agent, 2 parts of the first wax and 2 parts of the second wax as shown in Table 2, followed by melt kneading the mixture by using a biaxial extruder. The resin binder used consisted of resin A, resin B and resin C, which were mixed at the mixing ratio shown in Table 2. Used as the first wax having a melting point lower by at least 10° C. than the melting point of the resin B was rice wax having a melting point of 78° C., carnauba wax having a melting point of 83° C., or maleinated wax having a melting point of 100° C. On the other hand, used as the second wax having a melting point higher by at least 10° C. than the melting point of the resin B was polypropylene wax having a melting point of 145° C. or polyethylene wax having a melting point of 133° C.

The melt kneaded mixture thus obtained was cooled, followed by roughly pulverizing the cooled mixture in a hammer mill. Then, the roughly pulverized mixture was finely pulverized by using a jet pulverizer, followed by classifying the finely pulverized mixture so as to obtain toner particles having an average particle diameter of 9 $\mu$m. Further, toner was prepared by adding 0.5 parts of a hydrophobic silica and 0.5 parts of a hydrophobic titanium oxide to 100 parts of the toner particles and sufficiently mixing the mixture in a Henschel mixer.

Finally, a developing agent was prepared by mixing in a Nouter mixer 8 parts of the toner noted above and 100 parts of the resin-coated carrier prepared in the example of the carrier manufacture described above.

Comparative Example 1

A developing agent was obtained as in Example 12, except that a wax was not added in preparing the toner.

Comparative Example 2

A developing agent was obtained as in Example 12, except that the second wax having a melting point higher by at least 10° C. than the melting point of the resin B was not added in preparing the toner.

Comparative Example 3

A developing agent was obtained as in Example 12, except that the first wax having a melting point lower by at least 10° C. than the melting point of the resin B was not added in preparing the toner.

Comparative Example 4

A developing agent was obtained as in Example 12, except that styrene-methyl methacrylate resin having a monomer ratio of 50:50 between styrene and methyl methacrylate was used in place of the silicone resin for forming the fluidized bed.

Comparative Example 5

A developing agent was obtained as in Example 1, except that resin A was not used and the mixing ratio of resin B to resin C was changed as shown in Table 2.

Each of the developing agents thus prepared was tested. A fixing device is prepared by modifying the fixing device portion detached from Premarju 455(trade name of a copying machine manufactured by Toshiba Tec. K. K.).

Figure 2:
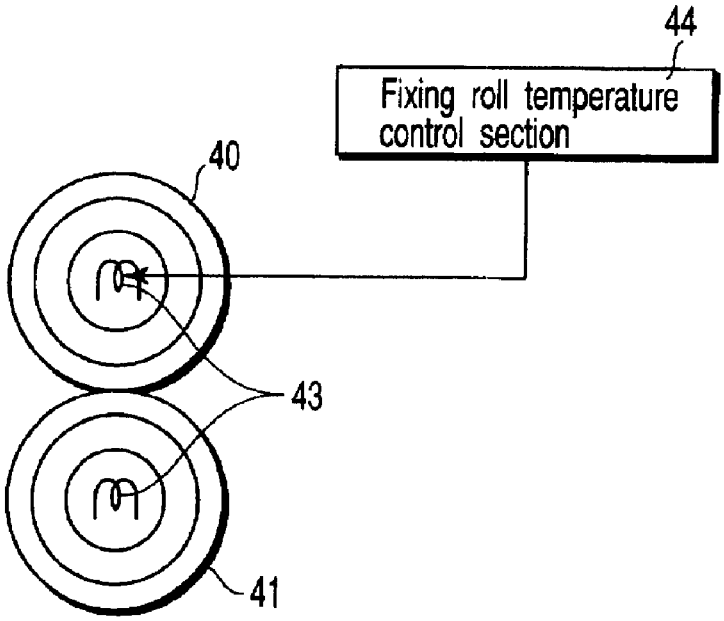
FIG. 2 schematically shows the construction of an apparatus used for conducting a fixing test.

FIG. 2 exemplifies the fixing device used for the evaluation test of the developing agent of the present invention. The fixing device was modified such that the fixing roll temperature would be variable, and the unfixed image was fixed by using the fixing device for the evaluation test. The fixing device shown in FIG. 2 comprises a hard roller 40, a rubber roller 41 arranged to face the hard roller 40, a heat source 43 arranged within each of these rollers 40 and 41, and a fixing roll temperature control section 44 connected to the heat source 43. The hard roller 40 and the rubber roller 41 are in contact with each other under a prescribed contact pressure so as to form a nip portion having a prescribed width.

An image was formed by using the fixing device shown in FIG. 2 in a manner to obtain an unfixed image.

The lowest fixing temperature, the non-offset range, the smear level, the charging properties and the image concentration were measured in respect of the image thus formed, with the results as shown in Table 3. Incidentally, the lowest fixing temperature, etc. were evaluated as follows.

The temperature at which at least 75% of the fixation remaining rate can be obtained was measured as the lowest fixing temperature.

The fixation remaining rate was calculated by the formula given below:

fixation remaining rate=image concentration before the friction/image concentration after the friction×100 (%)

To be more specific, a fixing treatment was applied to a transfer paper sheet having a toner image transferred thereonto by using the fixing device under the conditions that the load applied was 40N, the nip width was 7.5 mm, and the transfer rate for the fixation was set at 200 mm/sec, with the set temperature of the heat roller included in the fixing device elevated successively. The image concentration was measured in the image portion relative to the fixed image thus formed, and after friction was applied to the image portion with a cotton pad consisting of 100% of cotton, the image concentration was measured again so as to calculate the fixation remaining rate by the formula given above.

The non-offset range was measured by transferring the toner image and applying the fixing treatment under the conditions given above. Also, the operation to observe whether or not the stain with the toner is generated is performed under the state that the set temperature of the heat roller included in the fixing device was elevated successively. The temperature range within which the stain with the toner is not generated, i.e., the temperature range within which any of the low temperature offset taking place in the low temperature region and the high temperature offset taking place in the high temperature region is not generated, is determined as the non-offset range.

For measuring the smear level, samples directed to 10 stages of the smear level were prepared, and the smear level was measured on the basis of the smear level samples. The smear level within the non-offset temperature range was used as the average value of the smear level. It should be noted that the lower smear level denotes the better state in respect of the smear.

For measuring the charging properties, the toner and the carrier were left to stand for 12 hours under any of the low temperature and low humidity environment (L/L) in which the temperature was set at 10° C. and the humidity was set at 20%, the high temperature and the high humidity environment (H/H) in which the temperature was set at 35° C. and the humidity was set at 85%, and the normal temperature and the normal humidity environment (N/N) in which the temperature was set at 20° C. and the humidity was set at 50%, followed by preparing a developing agent by mixing the toner and the carrier at a prescribed mixing ratio. Then, the charging properties were measured by using a TB-220 type charged amount measuring device manufactured by Toshiba Chemical K. K. The charging properties were evaluated as follows:

◎: Difference in the charging properties among L/L, H/H, N/N is not larger than 3 $\mu$C/g;

○: Difference in the charging properties among L/L, H/H, N/N is 3 to 7 $\mu$C/g;

Δ: Difference in the charging properties among L/L, H/H, N/N is 7 to 10 μC/g;

x: Difference in the charging properties among L/L, H/H, N/N is not smaller than 10 μC/g;

Further, for measuring the image concentration, the image outputted onto a transfer sheet by using Premarju 455 manufactured by Toshiba Tec K. K. was measured by using a Macbeth densitometer manufactured by Sakata Inks K. K. under any of the low temperature and low humidity environment (L/L) in which the temperature was set at 10° C. and the humidity was set at 20%, the high temperature and the high humidity environment (H/H) in which the temperature was set at 35° C. and the humidity was set at 85%, and the normal temperature and the normal humidity environment (N/N) in which the temperature was set at 20° C. and the humidity was set at 50%. The image concentration was evaluated as follows:

⊙: Difference in the image concentration among L/L, H/H, N/N is not larger than 0.1;

○: Difference in the image concentration among L/L, H/H, N/N is 0.1 to 0.2;

Δ: Difference in the image concentration among L/L, H/H, N/N is 0.2 to 0.5;

x: Difference in the image concentration among L/L, H/H, N/N is not smaller than 0.5.

TABLE 1

| | | Softening point | Glass transition point | Temperature difference |
|---|---|---|---|---|
| First polyester resin | A1 | 101 | 62 | 39 |
| | A2 | 90 | 60 | 30 |
| | A3 | 115 | 68 | 47 |
| Second polyester resin | B1 | 120 | 123 | 3 |
| | B2 | 110 | 120 | 10 |
| Third polyester resin | C1 | 148 | 59 | 89 |
| | C2 | 155 | 60 | 90 |
| | C3 | 160 | 70 | 90 |

TABLE 2

| | Resin mixing ratio A:B:C | Coloring agent | Charge control agent | First wax | Second wax |
|---|---|---|---|---|---|
| Example 1 | A3:B2:C2 = 50:25:25 | Carbon black (manufactured by Mitsubishi Kagaku K.K.) 6 parts | Iron-containing azo compound (manufactured by Hodogaya Kagaku K.K.) 2 parts | Rice wax (manufactured by NS Chemical K.K.) 2 parts | Polyethylene wax (manufactured by Sanyo Kasei K.K.) 2 parts |
| Example 2 | A2:B2:C2 = 35:25:40 | Carbon black (manufactured by Mitsubishi Kagaku K.K.) 6 parts | Iron-containing azo compound (manufactured by Hodogaya Kagaku K.K.) 2 parts | Carnauba wax (manufactured by NS Chemical K.K.) 2 parts | Polyethylene wax (manufactured by Sanyo Kasei K.K.) 2 parts |
| Example 3 | A1:B2:C3 = 70:2:28 | Carbon black (manufactured by Mitsubishi Kagaku K.K.) 6 parts | Iron-containing azo compound (manufactured by Hodogaya Kagaku K.K.) 2 parts | Maleinated wax (manufactured by Chukyo Yushi K.K.) 2 parts | Polyethylene wax (manufactured by Sanyo Kasei K.K.) 2 parts |
| Example 4 | A3:B1:C3 = 50:20:30 | Carbon black (manufactured by Mitsubishi Kagaku K.K.) 6 parts | Iron-containing azo compound (manufactured by Hodogaya Kagaku K.K.) 2 parts | Rice wax (manufactured by NS Chemical K.K.) 2 parts | Polypropylene wax (manufactured Sanyo Kasei K.K.) 2 parts |
| Example 5 | A3:B2:C3 = 60:15:25 | Carbon black (manufactured by Mitsubishi Kagaku K.K.) 6 parts | Iron-containing azo compound (manufactured by Hodogaya Kagaku K.K.) 2 parts | Carnauba wax (manufactured by NS Chemical K.K.) 2 parts | Polypropylene wax (manufactured Sanyo Kasei K.K.) 2 parts |
| Example 6 | A3:B2:C1 = 50:10:40 | Carbon black (manufactured by Mitsubishi Kagaku K.K.) 6 parts | Iron-containing azo compound (manufactured by Hodogaya Kagaku K.K.) 2 parts | Maleinated wax (manufactured by Chukyo Yushi K.K.) 2 parts | Polypropylene wax (manufactured Sanyo Kasei K.K.) 2 parts |
| Example 7 | A1:B1:C3 = 70:2:28 | Carbon black (manufactured by Mitsubishi Kagaku K.K.) 6 parts | Iron-containing azo compound (manufactured by Hodogaya Kagaku K.K.) 2 parts | Rice wax (manufactured by NS Chemical K.K.) 2 parts | Polyethylene wax (manufactured Sanyo Kasei K.K.) 2 parts |
| Example 8 | A1:B2:C1 = 70:2:28 | Carbon black (manufactured by Mitsubishi Kagaku K.K.) 6 parts | Iron-containing azo compound (manufactured by Hodogaya Kagaku K.K.) 2 parts | Carnauba wax (manufactured by NS Chemical K.K.) 2 parts | Polyethylene wax (manufactured Sanyo Kasei K.K.) 2 parts |

TABLE 2-continued

| | Resin mixing ratio A:B:C | Coloring agent | Charge control agent | First wax | Second wax |
|---|---|---|---|---|---|
| Example 9 | A3:B1:C2 = 35:10:55 | Carbon black (manufactured by Mitsubishi Kagaku K.K.) 6 parts | Iron-containing azo compound (manufactured by Hodogaya Kagaku K.K.) 2 parts | Maleinated wax (manufactured by Chukyo Yushi K.K.) 2 parts | Polyethylene wax (manufactured Sanyo Kasei K.K.) 2 parts |
| Example 10 | A3:B1:C1 = 45:15:40 | Phthalocyanine blue (manufactured by Dainichi Sika K.K.) 6 parts | Zirconium-containing salicylic acid compound (manufactured by Hodogaya Kagaku K.K.) 2 parts | Rice wax (manufactured by NS Chemical K.K.) 2 parts | Polypropylene wax (manufactured Sanyo Kasei K.K.) 2 parts |
| Example 11 | A1:B2:C2 = 25:25:50 | Phthalocyanine blue (manufactured by Dainichi Sika K.K.) 6 parts | Zirconium-containing salicylic acid compound (manufactured by Hodogaya Kagaku K.K.) 2 parts | Carnauba wax (manufactured by NS Chemical K.K.) 2 parts | Polypropylene wax (manufactured Sanyo Kasei K.K.) 2 parts |
| Example 12 | A1:B1:C1 = 50:10:40 | Phthalocyanine blue (manufactured by Dainichi Sika K.K.) 6 parts | Zirconium-containing salicylic acid compound (manufactured by Hodogaya Kagaku K.K.) 2 parts | Maleinated wax (manufactured by Chukyo Yushi K.K.) 2 parts | Polypropylene wax (manufactured Sanyo Kasei K.K.) 2 parts |
| Example 13 | A2:B2:C3 = 50:10:40 | Phthalocyanine blue (manufactured by Dainichi Sika K.K.) 6 parts | Zirconium-containing salicylic acid compound (manufactured by Hodogaya Kagaku K.K.) 2 parts | Rice wax (manufactured by NS Chemical K.K.) 2 parts | Polyethylene wax (manufactured Sanyo Kasei K.K.) 2 parts |
| Example 14 | A2:B1:C2 = 35:10:55 | Phthalocyanine blue (manufactured by Dainichi Sika K.K.) 6 parts | Zirconium-containing salicylic acid compound (manufactured by Hodogaya Kagaku K.K.) 2 parts | Carnauba wax (manufactured by NS Chemical K.K.) 2 parts | Polyethylene wax (manufactured Sanyo Kasei K.K.) 2 parts |
| Example 15 | A1:B1:C2 = 75:25:0 | Phthalocyanine blue (manufactured by Dainichi Sika K.K.) 6 parts | Zirconium-containing salicylic acid compound (manufactured by Hodogaya Kagaku K.K.) 2 parts | Maleinated wax (manufactured by Chukyo Yushi K.K.) 2 parts | Polyethylene wax (manufactured Sanyo Kasei K.K.) 2 parts |
| Example 16 | A2:B1:C3 = 50:10:40 | Phthalocyanine blue (manufactured by Dainichi Sika K.K.) 6 parts | Zirconium-containing salicylic acid compound (manufactured by Hodogaya Kagaku K.K.) 2 parts | Rice wax (manufactured by NS Chemical K.K.) 2 parts | Polypropylene wax (manufactured Sanyo Kasei K.K.) 2 parts |
| Example 17 | A2:B1:C1 = 40:10:50 | Phthalocyanine blue (manufactured by Dainichi Seika K.K.) 6 parts | Zirconium-containing salicylic acid compound (manufactured by Hodogaya Kagaku K.K.) 2 parts | Carnauba wax (manufactured by NS Chemical K.K.) 2 parts | Polypropylene wax (manufactured Sanyo Kasei K.K.) 2 parts |
| Example 18 | A2:B2:C1 = 45:5:50 | Phthalocyanine blue (manufactured by Dainichi Seika K.K.) 6 parts | Zirconium-containing salicylic acid compound (manufactured by Hodogaya | Maleinated wax (manufactured by Chukyo Yushi K.K.) 2 parts | Polypropylene wax (manufactured Sanyo Kasei K.K.) 2 parts |

TABLE 2-continued

| | Resin mixing ratio A:B:C | Coloring agent | Charge control agent | First wax | Second wax |
|---|---|---|---|---|---|
| | | | Kagaku K.K.) 2 parts | | |
| Comparative Example 1 | A1:B1:C1 = 50:10:40 | Carbon black (manufactured by Mitsubishi Kagaku K.K.) 6 parts | Iron-containing azo compound (manufactured by Hodogaya Kagaku K.K.) 2 parts | None | None |
| Comparative Example 2 | A1:B1:C1 = 50:10:40 | Carbon black (manufactured by Mitsubishi Kagaku K.K.) 6 parts | Iron-containing azo compound (manufactured by Hodogaya Kagaku K.K.) 2 parts | Rice wax (manufactured by NS Chemical K.K.) 2 parts | None |
| Comparative Example 3 | A1:B1:C1 = 50:10:40 | Carbon black (manufactured by Mitsubishi Kagaku K.K.) 6 parts | Iron-containing azo compound (manufactured by Hodogaya Kagaku K.K.) 2 parts | None | Polypropylene wax (manufactured Sanyo Kasei K.K.) 2 parts |
| Comparative Example 4 | A2:B3:C2 = 25:50:25 | Carbon black (manufactured by Mitsubishi Kagaku K.K.) 6 parts | Iron-containing azo compound (manufactured by Hodogaya Kagaku K.K.) 2 parts | Rice wax (manufactured by NS Chemical K.K.) 2 parts | Polypropylene wax (manufactured Sanyo Kasei K.K.) 2 parts |
| Comparative Example 5 | B1:C1 = 25:75 | Carbon black (manufactured by Mitsubishi Kagaku K.K.) 6 parts | Iron-containing azo compound (manufactured by Hodogaya Kagaku K.K.) 2 parts | Rice wax (manufactured by NS Chemical K.K.) 2 parts | Polypropylene wax (manufactured Sanyo Kasei K.K.) 2 parts |

TABLE 3

| | Lowest fixing temperature (° C.) | Non-offset range (° C.) | Smear level | Charging properties | Image density |
|---|---|---|---|---|---|
| Example 1 | 125 | 125 to 210 | 2 to 3 | ○ | ○ |
| Example 2 | 130 | 135 to 210 | 2 to 3 | ○ | ○ |
| Example 3 | 140 | 140 to 230 | 5 to 6 | ○ | ◎ |
| Example 4 | 135 | 135 to 230 | 4 to 5 | ◎ | ◎ |
| Example 5 | 130 | 130 to 220 | 5 to 6 | ○ | ◎ |
| Example 6 | 135 | 140 to 220 | 4 to 5 | ○ | ◎ |
| Example 7 | 140 | 140 to 210 | 5 to 7 | ◎ | ◎ |
| Example 8 | 130 | 135 to 200 | 5 to 7 | ○ | ○ |
| Example 9 | 135 | 135 to 205 | 4 to 5 | ◎ | ◎ |
| Example 10 | 135 | 135 to 210 | 5 to 6 | ◎ | ◎ |
| Example 11 | 130 | 130 to 220 | 2 to 3 | ○ | ○ |
| Example 12 | 135 | 135 to 210 | 4 to 5 | ◎ | ◎ |
| Example 13 | 130 | 130 to 210 | 4 to 5 | ○ | ◎ |
| Example 14 | 135 | 135 to 200 | 4 to 5 | ◎ | ◎ |
| Example 15 | 135 | 135 to 190 | 2 to 3 | ○ | ○ |
| Example 16 | 140 | 140 to 210 | 4 to 5 | ◎ | ○ |
| Example 17 | 135 | 135 to 220 | 4 to 5 | ◎ | ○ |
| Example 18 | 140 | 140 to 200 | 4 to 5 | ○ | ◎ |
| Comparative Example 1 | None | None | None | ○ | Δ |
| Comparative Example 2 | 135 | 135 to 180 | 7 to 8 | Δ | ○ |
| Comparative Example 3 | 160 | 160 to 210 | 8 to 10 | Δ | ○ |
| Comparative Example 4 | 125 | 125 to 210 | 2 to 3 | x | x |
| Comparative Example 5 | 160 | 160 to 210 | 8 to 10 | Δ | ○ |

What is claimed is:

1. A developing agent containing toner particles, said toner particle containing a binder resin and a coloring agent, said binder resin containing a first polyester resin having a softening point Sp1 and a glass transition point Tg1, in which a difference between Tg1 and Sp1 falls within a range of between 30° C. and 50° C., a second polyester resin having a softening point Sp2 higher than said softening point Sp 1 and a glass transition point Tg2 in which a difference between Tg2 and Sp2 falls within a range of between 0.1° C. and 10° C. and having crystalline characteristics, a first wax having a melting point Mp1 higher than said softening point Sp2, and a second wax having a melting point Mp2 lower than said softening point Sp2.

2. The developing agent according to claim 1, wherein each of the difference between said softening point Sp2 and said melting point Mp1 and the difference between said softening point Sp2 and said melting point Mp2 is at least lot.

3. The developing agent according to claim 1, wherein said softening point Sp1 falls within a range of between 80° C. and 120° C., and said softening point Sp2 falls within a range of between 100° C. and 140° C.

4. The developing agent according to claim 1, wherein said binder resin further includes a third polyester resin having a softening point Sp3 higher than said softening point Sp2.

5. The developing agent according to claim 4, wherein said softening point Sp3 falls within a range of between 130° C. and 170° C.

6. The developing agent according to claim 4, wherein said third polyester resin has a glass transition point Tg3, and the difference between said glass transition point Tg3 and said softening point Sp3 falls within a range of between 80° C. and 100° C.

7. The developing agent according to claim 4, wherein the amount of said second polyester resin contained in said binder resin is larger than the amount of the first polyester resin contained in said binder resin, and the amount of the first polyester resin contained in said binder resin is larger than the amount of the third polyester resin contained in said binder resin, and the mixing ratio of the third, first and second polyester resins falls within a range of 0 to 55: 2 to 25: 35 to 75.

8. A developing agent comprising toner particles containing a binder resin and a coloring agent, said binder resin including a first polyester resin having a softening point Sp1, a second polyester resin having a softening point Sp2 higher than said softening point Sp1, and a third polyester resin having a softening point Sp3 higher than said softening point Sp2, and one of said first to third polyester resins having a crystallizability.

9. The developing agent according to claim 8, wherein the amount of said second polyester resin is smaller than the amount of any of said first and third polyester resins.

10. The developing agent according to claim 8, wherein said binder resin further includes a first wax having a melting point higher than said softening point Sp2 and a second wax having a melting point lower than said softening point Sp2.

11. The developing agent according to claim 8, wherein the one polyester resin having a crystallizability has a glass transition point, and a difference between the glass transition point and a softening point of the one polyester resin having a crystallizability ranges from 0.1° C. to 10° C.

* * * * *